US005755492A

United States Patent [19]

Iver

[11] Patent Number: 5,755,492

[45] Date of Patent: May 26, 1998

[54] FOLDING BACKREST WITH TWO INCLINATION ANGLES

[76] Inventor: Morton Iver, 535 Waterside Dr., Lantana, Fla. 33462

[21] Appl. No.: 797,167

[22] Filed: Feb. 10, 1997

[51] Int. Cl.[6] ..... A47C 7/36

[52] U.S. Cl. ..... 297/377; 297/352; 297/252; 5/633; 5/634

[58] Field of Search ..... 297/377, 352, 297/252; 5/633, 634

[56] References Cited

U.S. PATENT DOCUMENTS

| | | | |
|---|---|---|---|
| 1,363,697 | 12/1920 | Vieira | 297/377 X |
| 1,799,939 | 4/1931 | Wainewright et al. | 297/377 |
| 1,842,424 | 1/1932 | Ponten et al. | 297/377 |
| 1,865,030 | 6/1932 | McCauley | 297/377 X |
| 2,108,531 | 2/1938 | Flanders | 297/377 |
| 2,250,026 | 7/1941 | Laukhuff | 297/377 X |
| 2,368,436 | 1/1945 | Williams | 297/377 X |
| 2,570,571 | 10/1951 | Leeman | 297/377 |
| 2,663,029 | 12/1953 | Whittey et al. | 297/377 X |
| 2,777,138 | 1/1957 | Gallagher | 297/377 X |
| 2,816,599 | 12/1957 | Adams | 297/377 X |
| 2,884,991 | 5/1959 | Bloomquist | 297/377 |
| 3,092,224 | 6/1963 | O'Neil | 297/377 X |
| 3,120,008 | 2/1964 | Watson | 5/634 |
| 3,121,884 | 2/1964 | Emery | 5/634 |
| 3,342,294 | 9/1967 | Beatty | 297/377 X |
| 4,654,907 | 4/1987 | Haugaard | 297/377 X |
| 4,660,237 | 4/1987 | Brodnax | 297/377 X |
| 4,869,553 | 9/1989 | Powell | 297/377 |
| 4,926,512 | 5/1990 | Coyle | 297/377 X |
| 5,020,854 | 6/1991 | Powell | 297/377 |
| 5,437,069 | 8/1995 | Bates | 5/633 |
| 5,553,921 | 9/1996 | Schenk | 297/352 |

*Primary Examiner*—James R. Brittain
*Assistant Examiner*—Rodney B. White
*Attorney, Agent, or Firm*—Alvin S. Blum

[57] ABSTRACT

A folding backrest has a rigid rectangular frame supporting a resilient fabric planar panel stretched thereon. A wedge shaped support structure folds flat against the fabric for storage and transport and unfolds to support the frame tilted up on the sand with either end of the frame against the sand to provide selectable high or low inclination angle on the supporting sand. The panel fabric may extend beyond the frame ends to provide a covering on the sand for sitting thereon.

6 Claims, 1 Drawing Sheet

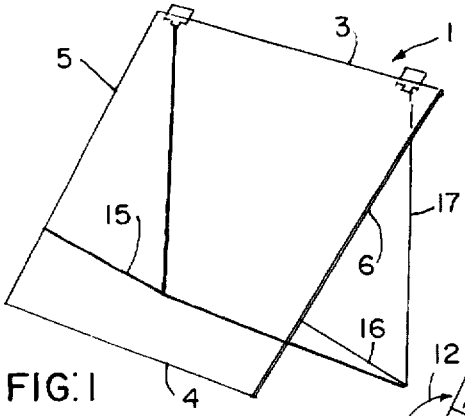
FIG. 1
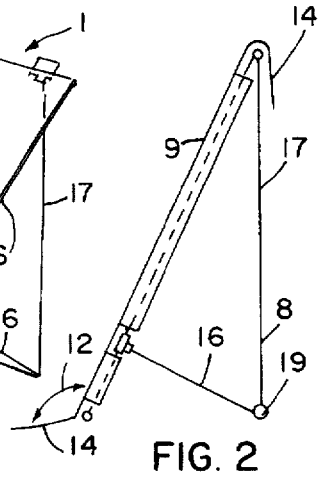
FIG. 2
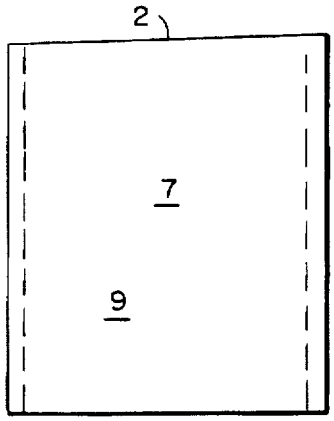
FIG. 3
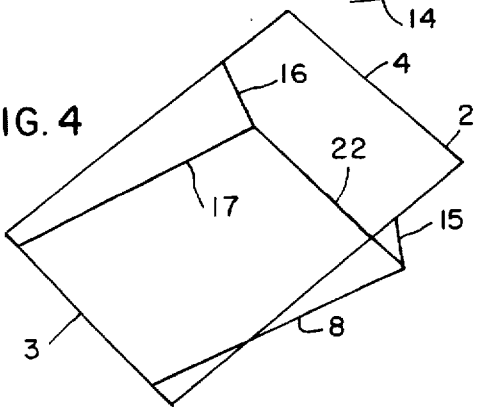
FIG. 4
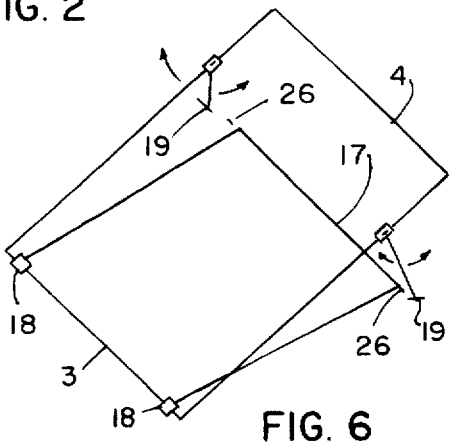
FIG. 6
FIG. 5
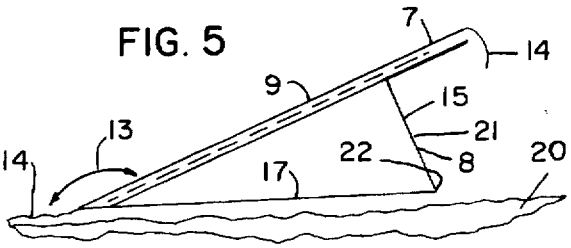
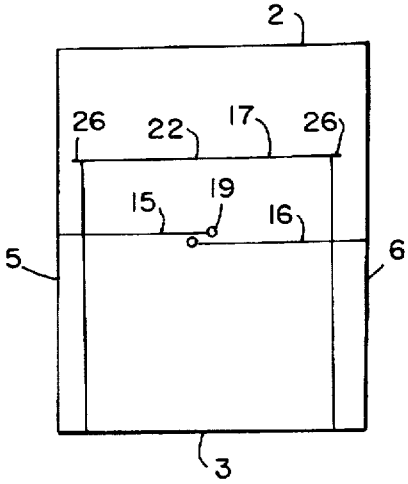
FIG. 7
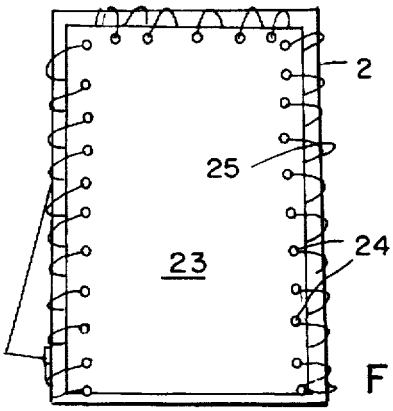
FIG. 8

FOLDING BACKREST WITH TWO INCLINATION ANGLES

FIELD OF THE INVENTION

The instant invention relates to backrests and, more particularly, to portable folding backrests for use while sitting on the beach said, and having two different angles of inclination.

BACKGROUND OF THE INVENTION

People on the sand at the beach may be comfortable lying flat on a towel while sunbathing for a limited time period. Eventually, they want to sit up. Folding chairs are generally carried to the beach for this purpose. The chairs may be provided with pivotable backrests for adjusting the angle of inclination of the backrest. These chairs are heavy and awkward to carry and set up. At the beach, many people don't need a chair to elevate their buttocks above the sand. They really only need the backrest portion of the chair so that they can sit up on the sand.

SUMMARY OF THE INVENTION

It is, accordingly, an object of the invention to provide a portable, folding backrest that can be used without a chair for sitting up on a horizontal surface such as beach sand. It is another object that the backrest provide two different angles of inclination. It is yet another object that the backrest have a resilient fabric back support surface supported on a rigid frame. It is yet another object that the rigid frame fold flat for ease of carrying and storing.

These and other objects, advantages and features of the invention will become apparent when the detailed description is studied in conjunction with the drawings in which like reference characters designate like elements in the various drawing figures.

BRIEF DESCRIPTION OF THE DRAWINGS

FIG. 1 is a perspective view of the opened backrest frame in the high angle position.

FIG. 2 is a side elevation view of the opened backrest in the high angle position.

FIG. 3 is a front elevation view of the opened backrest in the high angle position.

FIG. 4 is a perspective view of the opened backrest frame in the low angle position.

FIG. 5 is a side elevation view of the opened backrest in the low angle position.

FIG. 6 is a perspective view as in FIG. 4 with the frame partial folded.

FIG. 7 is a plan view of the folded frame.

FIG. 8 is a perspective view of another embodiment of the invention.

DETAILED DESCRIPTION OF PREFERRED EMBODIMENTS

Referring now first to FIGS. 1–7, the invention comprises a portable folding reclining backrest 1 for use on a horizontal supporting surface such as beach sand 20. A rigid quadrilateral frame 2 may be made out of polyvinyl chloride (PVC) pipe of the type used in outdoor furniture. A web panel 7 such as a woven synthetic fabric in the form of a sleeve is tightly stretched over the frame 2 to provide a back supporting plane 9. A folding brace assembly 8 in a first mode of operation folds substantially flat to lie substantially coplanar with plane 9 for convenient transport and storage (FIG. 7). Two struts, 15 and 16, pivot about side members 5 and 6 of the frame. They pivot out to a position orthogonal to plane 9 and engage rectangular element 17 which pivots about first end member 3 of frame 2 at pivots 18 to form a rigid, triangular, wedge shaped structure 21 to support the frame tilted up on the supporting surface 20 to provide the low inclined angle 13 of FIG. 5, in which first end member 3 of the frame rests on the sand. Alternatively, the high inclined angle 12 of FIG. 2 is provided without any adjustment by simply resting the second end member 4 on the sand.

The rectangular element 17 has an end pipe 22 whose ends 26 removably fit into T connectors 19 at the terminus of each strut to form the rigid wedge-shaped support 21 without requiring special skills, tools or adjustments. And either of the two angles is selected by simply rotating the entire device. The web panel 7 may extend past end members 3,4 to provide a covering 14 over the sand great enough to sit on.

The web panel may take various forms well known in the art.

FIG. 8 illustrates one of those forms in which the web panel 23 is tightly stretched and secured to the rectangular frame 2 by a rope 25 passing through grommets 24 on the edge of panel 23.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A portable folding reclining backrest for use on a horizontal support surface such as beach sand, the backrest comprising:

a rigid quadrilateral frame having a first end member and an opposed, spaced apart, second end member, the end members having ends fixedly attached to a first side member and an opposed, spaced apart, second side member;

a web panel stretched and secured to the rigid frame and defining a back supporting plane for a user sitting on a horizontal support surface that defines a horizontal plane;

a folding brace assembly pivotably attached to one of the end members intermediate the ends thereof and also pivotably attached to the two side members of the frame, the brace assembly having two modes of operation, a first mode of operation in which the assembly lies folded substantially flat and coplanar with the back supporting plane for transport and storage, and a second mode of operation in which the brace assembly forms a rigid, triangular, wedge-shaped structure extending away from the back supporting plane such that when the first end member and the assembly are both resting on the horizontal support surface, the back supporting plane is at a first angle to the horizontal plane and when the second end member and the assembly are both resting on the horizontal support surface, the back supporting plane is at a second angle to the horizontal plane.

2. The backrest according to claim 1, in which the web panel extends past both the first and second end members to provide a covering over the horizontal support surface great enough to sit on.

3. The backrest according to claim 2, in which the brace assembly comprises a rectangular element pivotably attached to one of the end members and first and second struts pivotably attached to the first and second side members respectively, the struts being removably attachable to the rectangular element in the second mode of operation.

4. The backrest according to claim 1, in which the brace assembly comprises a rectangular element pivotably attached to one of the end members and first and second struts pivotably attached to the first and second side members respectively, the struts being removably attachable to the rectangular element in the second mode of operation.

5. A portable folding reclining backrest for use on a horizontal support surface such as beach sand, the backrest comprising:

a rigid quadrilateral frame having opposed, spaced apart first and second end members fixedly attached to opposed, spaced apart first and second side members;

a web panel stretched and secured to the rigid frame and defining a back supporting plane for a user sitting on a horizontal support surface that defines a horizontal plane, the web panel extending past both the first and second end end members to provide a covering over the horizontal support surface great enough to sit on;

a folding brace assembly pivotably attached to at least three of the members of the frame, the brace assembly having two modes of operation, a first mode of operation in which the assembly lies folded substantially flat and coplanar with the back supporting plane for transport and storage, and a second mode of operation in which the brace assembly forms a rigid, triangular, wedge-shaped structure extending away from the back supporting plane such that when the first end member and the assembly are both resting on the horizontal support surface, the back supporting plane is at a first angle to the horizontal plane and when the second end member and the assembly are both resting on the horizontal support surface, the back supporting plane is at a second angle to the horizontal plane, and in which the brace assembly comprises a rectangular element pivotably attached to one of the end members and first and second struts pivotably attached to the first and second side members respectively, the struts being removably attachable to the rectangular element in the second mode of operation.

6. A portable folding reclining backrest for use on a horizontal support surface such as beach sand, the backrest comprising:

a rigid quadrilateral frame having opposed, spaced apart first and second end members fixedly attached to opposed, spaced apart first and second side members;

a web panel stretched and secured to the rigid frame and defining a back supporting plane for a user sitting on a horizontal support surface that defines a horizontal plane;

a folding brace assembly pivotably attached to at least three of the members of the frame, the brace assembly having two modes of operation, a first mode of operation in which the assembly lies folded substantially flat and coplanar with the back supporting plane for transport and storage, and a second mode of operation in which the brace assembly forms a rigid, triangular, wedge-shaped structure extending away from the back supporting plane such that when the first end member and the assembly are both resting on the horizontal support surface, the back supporting plane is at a first angle to the horizontal plane and when the second end member and the assembly are both resting on the horizontal support surface, the back supporting plane is at a second angle to the horizontal plane, and in which the brace assembly comprises a rectangular element pivotably attached to one of the end members and first and second struts pivotably attached to the first and second side members respectively, the struts being removably attachable to the rectangular element in the second mode of operation.

* * * * *